US008882209B1

(12) United States Patent
Castillo

(10) Patent No.: US 8,882,209 B1
(45) Date of Patent: Nov. 11, 2014

(54) CORDED WALL ASSEMBLY ADAPTED FOR INSTALLATION AT AN ARTICLE STORAGE SPACE

(76) Inventor: Alissandro Roque Castillo, Mooresville, NC (US)

( * ) Notice: Subject to any disclaimer, the term of this patent is extended or adjusted under 35 U.S.C. 154(b) by 125 days.

(21) Appl. No.: 13/399,209

(22) Filed: Feb. 17, 2012

(51) Int. Cl.
*A47B 81/00* (2006.01)

(52) U.S. Cl.
USPC ..... 312/292

(58) Field of Classification Search
USPC ..... 211/189, 119.003; 160/327–329, 332; 312/292
See application file for complete search history.

(56) References Cited

U.S. PATENT DOCUMENTS

| | | | | | |
|---|---|---|---|---|---|
| 795,972 | A | * | 8/1905 | Harding | 160/396 |
| 1,909,949 | A | * | 5/1933 | Hammonds | 160/105 |
| 2,261,609 | A | * | 11/1941 | Vass | 160/329 |
| 3,420,379 | A | * | 1/1969 | Berryman | 211/1 |
| 3,766,960 | A | * | 10/1973 | McLaughlin, Jr. | 160/405 |
| 3,861,704 | A | * | 1/1975 | De Witte | 280/79.3 |
| 4,416,463 | A | * | 11/1983 | Marsh et al. | 280/79.3 |
| 5,443,586 | A | * | 8/1995 | Cargill | 410/143 |

* cited by examiner

*Primary Examiner* — Matthew Ing
(74) *Attorney, Agent, or Firm* — Schwartz Law Firm, P.C.

(57) ABSTRACT

A corded wall assembly is adapted for installation at an article storage space defined by at least two opposing spaced-apart structural elements. The corded wall assembly includes first and second elongated rigid frame members, and a plurality of elastic cords attached at respective opposite ends to the frame members. Mounting elements attach the first and second frame members to respective spaced-apart structural elements of the article storage space.

8 Claims, 6 Drawing Sheets

CORDED WALL ASSEMBLY ADAPTED FOR INSTALLATION AT AN ARTICLE STORAGE SPACE

TECHNICAL FIELD AND BACKGROUND OF THE INVENTION

This invention relates broadly and generally to a corded wall assembly adapted for installation at an article storage space.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a corded wall assembly adapted for installation at an article storage space defined by at least two opposing spaced-apart structural elements. The corded wall assembly includes first and second elongated rigid frame members, and a plurality of elastic cords attached at respective opposite ends to the frame members. Means are provided for mounting the first and second frame members to respective spaced-apart structural elements of the article storage space.

As used herein, the term "article storage space" refers broadly to any open space sufficient for receiving and storing loose items. Examples of article storage spaces include, but are not limited to, cabinet spaces, closet spaces, spaces above and below shelving, space inside freestanding storage compartments, and the like.

The term "structural element" refers broadly herein to any structure which forms or defines, in whole or in part, an article storage space.

The term "rigid frame member" refers broadly herein to any member capable of holding one or more elastic cords. The exemplary frame members may be non-structural and non-load bearing. The frame members may be integrally formed together with other frame members or structure, and may cooperate to (at least partially) define openings of various geometric shapes including, for example, rectangular, triangular, circular, oval, or the like.

The "plurality of elastic cords" may comprise separate, individual cord lengths spanning from one frame member to the other; or, alternatively, one single cord length which attaches to the opposing frame members in a serpentine fashion or other such manner.

According to another exemplary embodiment, the first and second frame members comprise a horizontal top frame member and a horizontal bottom frame member.

According to another exemplary embodiment, each of the top and bottom horizontal frame members defines a longitudinal channel and a plurality of spaced apart cord holes passing through the member.

According to another exemplary embodiment, the elastic cords have respective opposing knotted ends residing within the longitudinal channels of respective top and bottom frame members.

According to another exemplary embodiment, the means for mounting comprises a double-sided adhesive tape. Alternative mounting means may comprise, for example, liquid glues or other bonding agents; or hardware, such as screws, nails, staples, or the like; or mechanical clamping or fastening devices; or complementary hook and loop fasteners.

According to another exemplary embodiment, the assembly incorporates between 4 and 8 spaced-apart elastic cords attached at respective opposite ends to said first and second frame members.

According to another exemplary embodiment, when the corded wall assembly is installed, the plurality of elastic cords are disposed substantially parallel to one another.

According to another exemplary embodiment, when the corded wall assembly is installed, adjacent ones of the plurality of elastic cords are disposed approximately 2-5 inches apart from one another.

In another exemplary embodiment, the present disclosure comprises a corded wall assembly in combination with an article storage cabinet. The corded wall assembly is installed between at least two opposing spaced-apart structural elements of the cabinet. The corded wall assembly comprises first and second elongated rigid frame members, and a plurality of elastic cords attached at respective opposite ends to the frame members. Means are provided for mounting the first and second frame members to respective spaced-apart structural elements of the cabinet.

In yet another exemplary embodiment, the present disclosure comprises a method for storing loose articles in a storage space defined by at least two opposing spaced-apart structural elements. The method includes mounting first and second elongated rigid frame members to respective opposing spaced-apart structural elements of the storage space. A plurality of elastic cords are located between the first and second frame members. The elastic cords cooperate with the frame members to form a corded wall assembly. Loose articles are then stored within the storage space behind the corded wall assembly.

According to another exemplary embodiment, mounting the first and second frame members comprises applying a double-sided adhesive tape to each frame member. The adhesive tape resides between the frame member and adjacent structural element of the storage space.

According to another exemplary embodiment, the method includes arranging the elastic cords vertically between the frame members and substantially parallel to one another.

According to another exemplary embodiment, the method includes spacing the elastic cords approximately 2-5 inches apart from one another.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
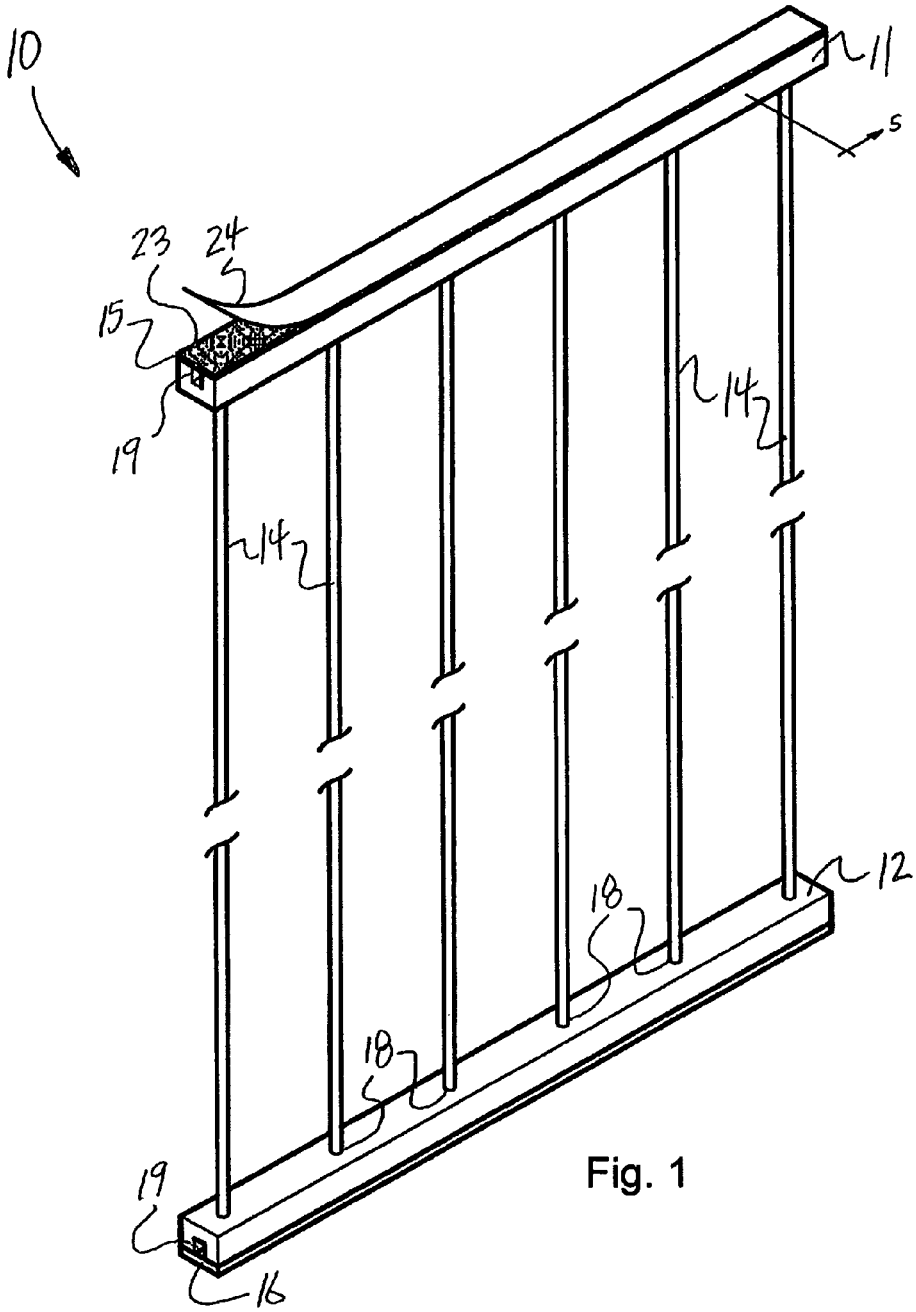
FIG. 1 is a perspective view of an exemplary corded wall assembly according to one embodiment of the present disclosure.

Referring now specifically to the drawings, a corded wall assembly according to one exemplary embodiment of the present disclosure is illustrated in FIG. 1, and shown generally at broad reference numeral 10. The exemplary wall assembly 10 is particularly applicable for installation at an article storage space, such as the cabinet opening "C" with a hinged cabinet door "D" shown in FIGS. 6 and 7. The wall assembly 10 may be packaged in a kit with disassembled or partially assembled parts, and may be designed for ready do-it-yourself installation by a homeowner or other user.

Figure 2:
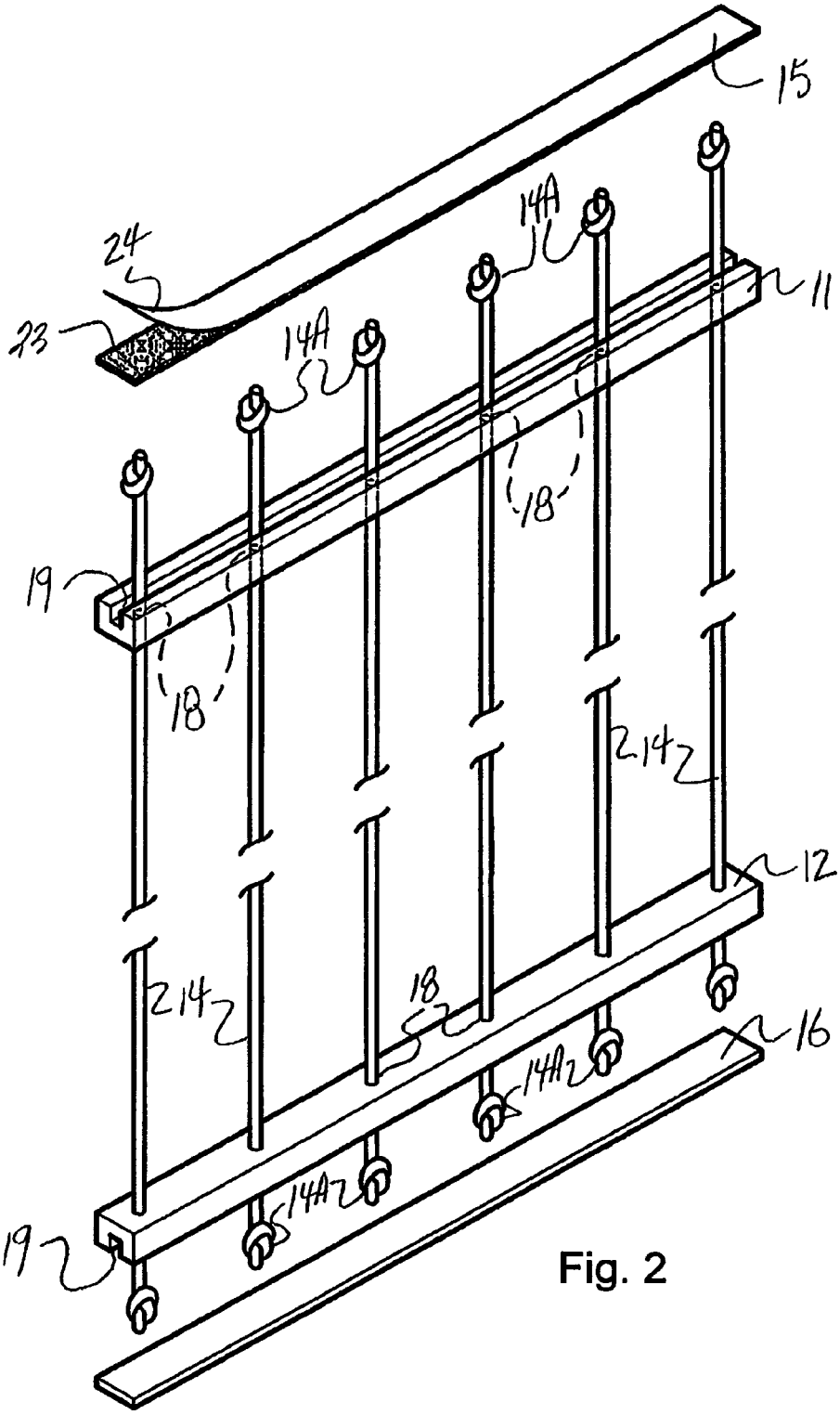
FIG. 2 is a further perspective view of the exemplary wall assembly with various parts separated and repositioned for clarity.
Figure 3:
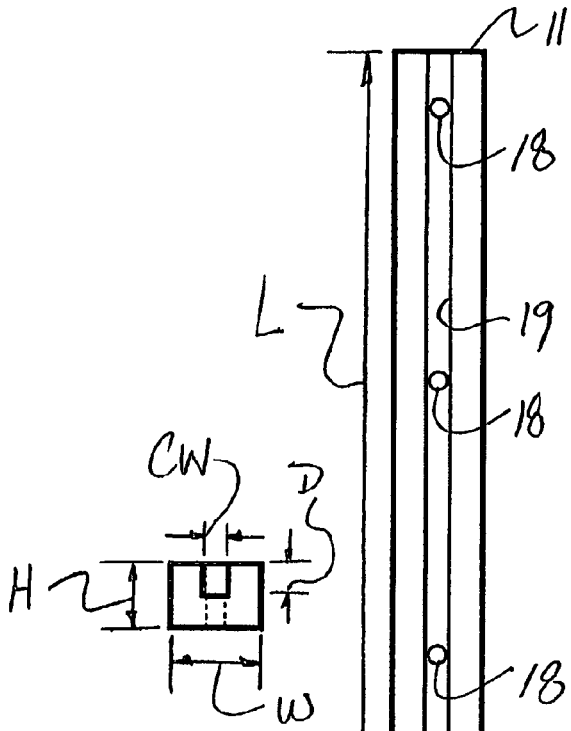
FIG. 3 is an end view of an exemplary frame member of the present assembly.
Figure 4:
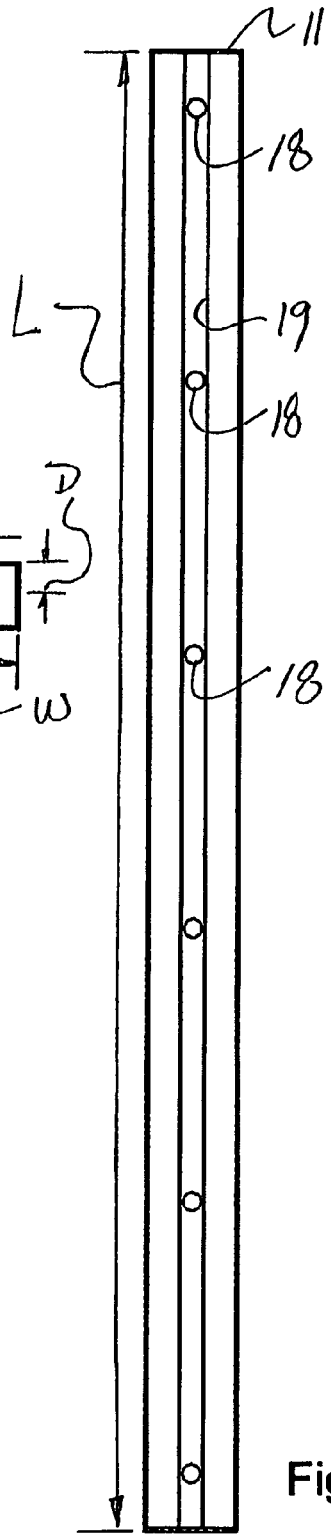
FIG. 4 is a channel-side view of the exemplary frame member.
Figure 5:
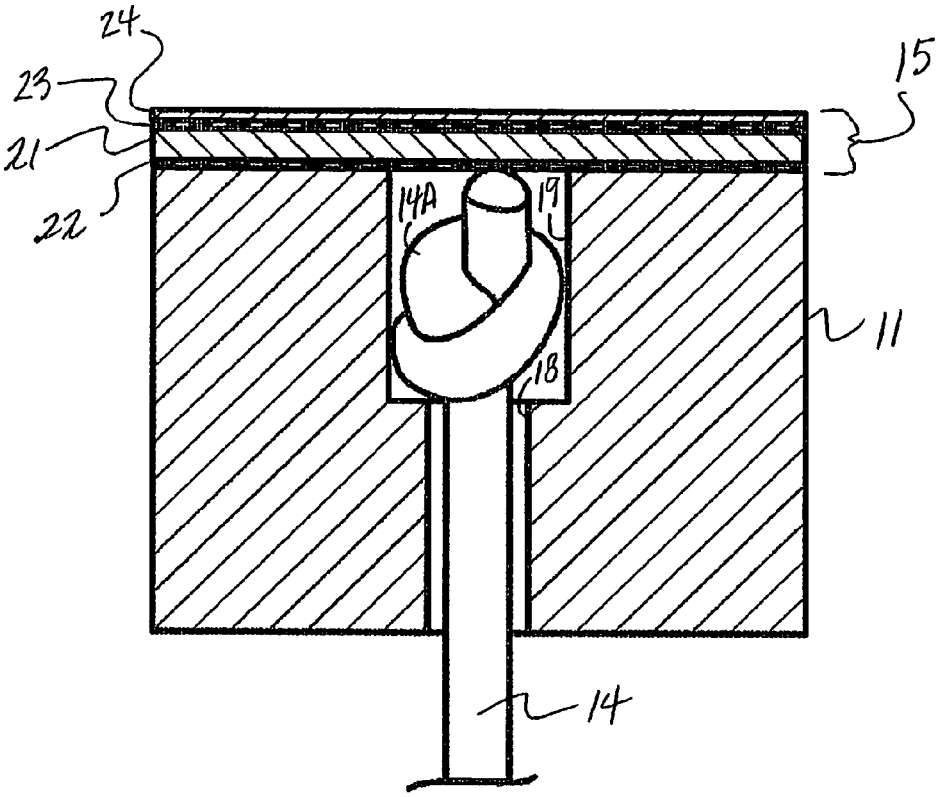
FIG. 5 is an enlarged cross-sectional view of the frame member in an assembled exemplary wall assembly.

As shown in FIGS. 1 and 2, the present wall assembly 10 incorporates identical elongated rigid frame members 11 and 12, a number of identical flexible (e.g., ⅛ inch) elastic cords 14, and identical thin adhesive mounting strips 15 and 16. Each frame member 11, 12 defines small spaced-apart cord holes 18 which communicate with an open longitudinal channel 19 extending from one end of the frame member 11, 12 to the other. A single frame member 11 is shown in FIGS. 3 and 4 (frame member 12 being identical to that shown). The cord holes 18 are formed to receive respective ends of the elastic cords 14. After passing through the cord holes 18, the ends 14A are knotted, as best shown in FIG. 2, to secure the cords 14 to the frame member 11. The opposing cord ends may be secured to the other frame member 12 in an identical manner. In the exemplary embodiment, the knotted cord ends 14A reside substantially entirely within the longitudinal channel 19 of each frame member 11, 12, as shown in FIG. 5. While the elastic cords 14 may be custom-arranged in any desired configuration, the present embodiment illustrates the cords 14 extending generally perpendicular to the frame members 11, 12 with adjacent cords 14 being disposed substantially parallel to one another.

After securing the elastic cords 14, as discussed above, the adhesive mounting strips 15, 16 are applied to respective frame members 11, 12 over the open channels 19. The mounting strips 15, 16 may have length and width dimensions corresponding substantially to the length and width dimensions of the frame members 11, 12. For example, referring to FIGS. 3 and 4, the length "L" of each frame member 11, 12 is approximately 11.500 inches, the width "W" of each frame member 11, 12 is approximately 0.688 inches, and the height "H" of each frame member 11, 12 is approximately 0.500 inches. The depth "D" of the longitudinal channel 19 is approximately 0.250 inches, and the channel width "CW" is approximately 0.188 inches. The exemplary frame members 11, 12 each have 6 equally spaced cord holes 18, each hole having a diameter "DA" of approximately 0.141 inches. The cord holes 18 are spaced approximately 2.125 inches apart.

As best shown in FIGS. 1, 2, and 5, each exemplary mounting strip 15, 16 comprises a flexible or semi-rigid flat substrate 21, contact adhesive coatings 22, 23 applied to opposite sides of the substrate 21, and disposable release-paper covers 24 (only one shown) for protecting the adhesive coatings 22, 23 prior to use. One of the release-paper covers (not shown) is first removed to expose the adhesive coating 22 and permanently attach the mounting strip 15, 16 to the frame member 11, 12. See FIGS. 1 and 5. When the wall assembly 10 is ready for installation, the second release-paper cover 24 may be removed from the mounting strip 15, 16 to expose the outside adhesive coating 23. This adhesive coating 23 is then pressed firmly against an inside edge of the cabinet (or other structural element) to affix the frame member 11, 12 to the cabinet. The other frame member 11, 12 may be affixed to the opposite inside edge of the cabinet (or other structural element) in an identical manner. Each mounting strip 15, 16 may alternatively comprise a conventional double-sided adhesive tape.

Figure 6:
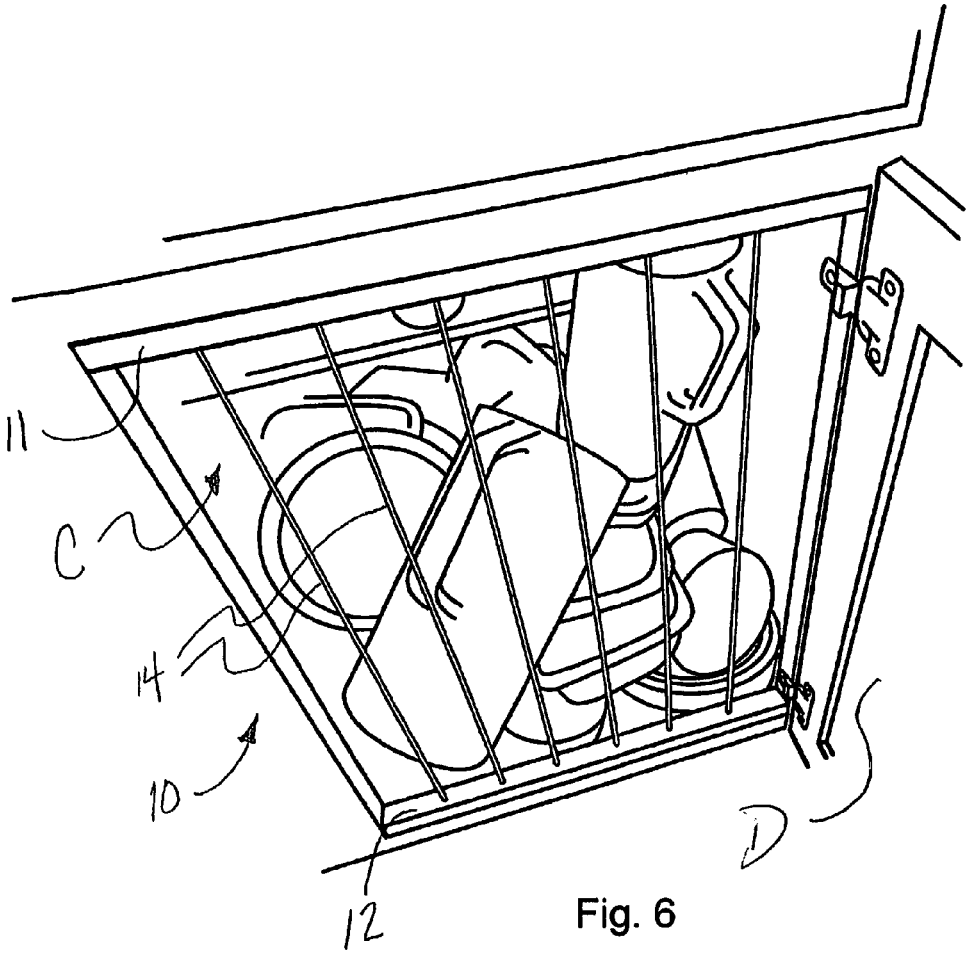
FIG. 6 is an environmental view of the exemplary wall assembly installed at a cabinet opening.
Figure 7:
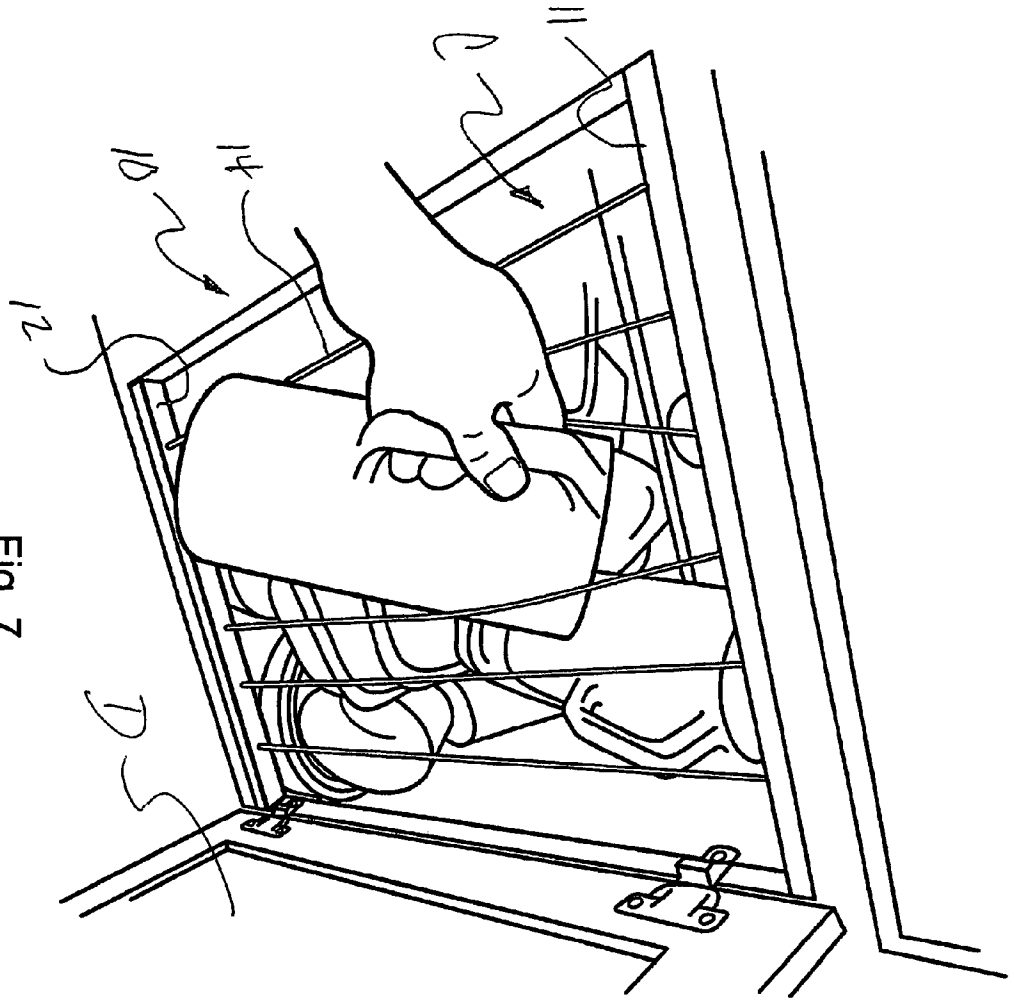
FIG. 7 is a further environmental view of the installed wall assembly, and demonstrating the removal of a loose item retained with the cabinet space.

Referring to FIGS. 6 and 7, once properly installed the corded wall assembly 10 functions to retain loose items, such as empty food storage containers, plastic beverage pitchers, and the like, within the cabinet space "C". To access items stored in the cabinet space "C", the user reaches through adjacent elastic cords 14 of the wall assembly 10 and pulls out the desired item without inadvertently removing other unwanted items from the cabinet space. The elastic cords 14 allow sufficient stretch and flex to enable the selected item to be readily removed or inserted, and then immediately return to their original form with sufficient tautness to securely retain the loose items inside the cabinet space.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. In combination with an article storage cabinet defining an interior article storage space and comprising a hinged cabinet door attached at an opening of said storage cabinet, a corded wall assembly adapted for installation between at least two opposing spaced-apart structural elements at the opening of said cabinet, said corded wall assembly comprising:

first and second elongated rigid frame members mounted to respective spaced-apart structural elements at the opening of said cabinet;

a plurality of elastic cords attached at respective opposite ends to said first and second frame members; and means for mounting said first and second frame members to respective spaced-apart structural elements of said cabinet;

whereby said corded wall assembly functions to retain loose items within the article storage space of said cabinet when the hinged cabinet door is open, such that users can reach through adjacent elastic cords of said wall assembly to pull out a desired item without inadvertently removing other unwanted items from the storage space.

2. The article storage cabinet according to claim 1, wherein said first and second frame members comprise a horizontal top frame member and a horizontal bottom frame member.

3. The article storage cabinet according to claim 2, wherein each of said top and bottom horizontal frame members defines a longitudinal channel and a plurality of spaced apart cord holes passing through said member.

4. The article storage cabinet according to claim 3, wherein said elastic cords have respective opposing knotted ends residing within the longitudinal channels of respective top and bottom frame members.

5. The article storage cabinet according to claim 1, wherein said means for mounting comprises a double-sided adhesive tape.

6. The article storage cabinet according to claim 1, and comprising between 4 and 8 spaced-apart elastic cords attached at respective opposite ends to said first and second frame members.

7. The article storage cabinet according to claim 1, wherein upon installation of said corded wall assembly, said plurality of elastic cords are disposed substantially parallel to one another.

8. The article storage cabinet according to claim 7, wherein upon installation of said corded wall assembly, adjacent ones of said plurality of elastic cords are disposed approximately 2-5 inches apart from one another.

* * * * *